United States Patent [19]

Peterson, Jr.

[11] 4,151,960

[45] May 1, 1979

[54] COMMINUTION DEVICE

[75] Inventor: Russell T. Peterson, Jr., Oil City, Pa.

[73] Assignee: Conair, Inc., Franklin, Pa.

[21] Appl. No.: 848,939

[22] Filed: Nov. 7, 1977

[51] Int. Cl.[2] ..... B02C 18/22

[52] U.S. Cl. ..... 241/73; 241/89; 241/285 B

[58] Field of Search ..... 241/73, 89, 89.1, 89.2, 241/89.3, 224, 285 A, 285 B

[56] References Cited

U.S. PATENT DOCUMENTS

| | | | |
|---|---|---|---|
| 2,149,289 | 3/1939 | Hall | 241/285 B UX |
| 2,975,985 | 3/1961 | Shelton, Jr. | 241/89 |
| 3,756,519 | 9/1973 | Reynolds et al. | 241/285 B |
| 4,008,857 | 2/1977 | Schutte | 241/89.2 |

FOREIGN PATENT DOCUMENTS

| | | | |
|---|---|---|---|
| 235652 | 3/1960 | Australia | 241/89 |
| 638103 | 10/1936 | Fed. Rep. of Germany | 241/89 |

*Primary Examiner*—Howard N. Goldberg

[57] ABSTRACT

A comminution device having an improved means for supporting and gaining access to the sizing screen as well as an improved arrangement for material discharge from such comminution device.

20 Claims, 3 Drawing Figures

COMMINUTION DEVICE

Cross reference to related applications: copending United States Patent Application Ser. No. 854,129, filed Nov. 23, 1977, entitled "Comminution Device" and assigned to the same assignee as is this invention.

Comminution devices are used in various industries with one particularly well known prior use being in the plastics industry in which such devices are commonly referred to as plastics granulators. Plastics granulators are often used to fragmatize pieces or sections of plastic material which constitutes scrap or waste from various plastic forming operations so that the fragmatized pieces may be reused in subsequent plastic forming operations. One common type of plastics granulator is provided with a plurality of bed knives positioned around the cutting circle of a multi-bladed rotary cutting member with the plastic material being cut or fragmatized by the well known cooperative action of the rotating knives and the bed knives. A sizing screen is provided below such cutting section or chamber to gravitationally receive the cut particles. The sizing screen segregates or screens the cut particles so that particles too large for subsequent forming operations are retained and recirculated within the cutting section and the remaining cut particles pass through the sizing screen and are of a size to permit their use in subsequent forming operations.

During the operation of such plastic granulators some plugging or bonding of portions of the discharge screen frequently occurs which plugging results in a decrease in the discharge of cut particles through the screen. Such decrease in particle discharge frequently creates a build up of particles within the cutting section with increased recirculation of particles therein and possible eventual melting of the particles being recirculated. In the more extreme situations of build up of particles can produce a fire hazard. Thus screen plugging normally requires stoppage of the machine and substantial downtime to clean the sizing screen. As a preventive maintenance measure it is also a common practice to periodically clean a sizing screen. Also in many instances it is desirable to change or replace the sizing screen such as when cutting a material of a different color or when a different size of cut particles is desired.

With existing plastic granulators, access to the screen is generally obtained by physically removing the lower hopper or lower housing portion. In view of the size of such components physical removal is frequently quite difficult. In some plastic granulators the use of auxiliary equipment such as levers or the like is required to remove the lower hopper. Furthermore, with access to the screen by removal of the bottom housing portion, the upper surface of the screen cannot be cleaned unless the screen itself is removed or additional access is gained to the upper surface of the screen by removing the upper portion of the housing. Existing plastic granulators also generally use a one-piece screen having the ends thereof bolted in position with removal of the bolts and reinsertion of the screen frequently requiring substantial physical discomfort such as having an operator lie in a prone position to accomplish these functions.

Still further, screens of many existing plastic granulators have supports therefor only adjacent the axial ends thereof. Such two point support coupled with the forces imparted to the screen by the rotating knives acting on the cut particles creates a substantial moment at the midpoint between the supports which moment may cause buckling or twisting of the screen.

The present invention includes a hopper having a pair of sections which are pivotal outwardly from a central axis to provide a safe and easy access to the interior side of the sizing screen whereby the screen can be readily cleaned or replaced. In addition the screen is in two portions with each portion being movable with a respective housing or hopper section. One side of each screen sections is secured to the pivotal sections and the other side of each screen is captively maintained in position when the hopper sections are in the closed position.

Accordingly, a primary object of this invention is to provide a new and improved access to the sizing screen in a plastics granulator.

Another object of this invention is to provide a sizing screen in a plastics granulator which has a three point support to substantially reduce the bending moments applied to the screen.

Still another object of this invention is to provide an improved discharge means for fragmatized plastic material in a plastic granulator. More specifically, a continuous material discharge is obtained from the granulator by a flight conveyor within the hopper sections which continuously conveys the cut particles laterally therefrom to provide a granulator of minimum height.

These and other objects and advantages of the present invention will become more readily apparent upon consideration of the following detailed description and drawing of the presently preferred embodiment thereof in which.

Figure 2:
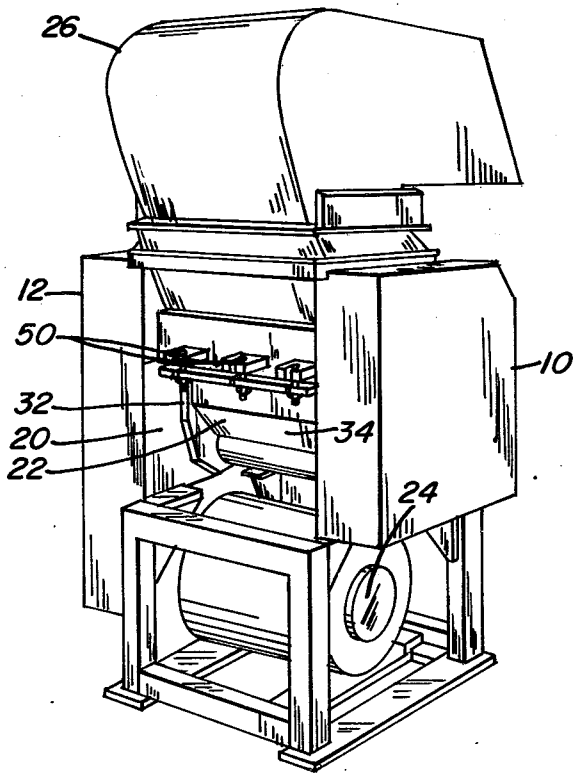
FIG. 2 is a prospective view of the device of FIG. 1 viewed from the oppsite side from the view of FIG. 1 with the sizing screen and support being in the closed position.
Figure 1:
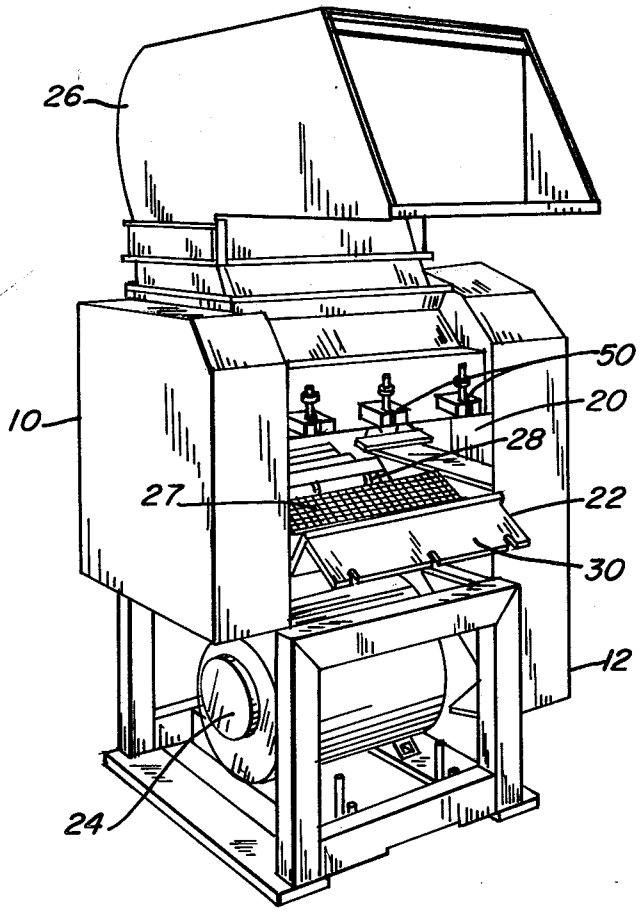
FIG. 1 is a prospective view of a comminution device constructed in accordance with the principles of the present invention with the sizing screen and support thereof being in the open position.

One known form of plastics granulator comprises a formed support or housing 10 having a vertically extending portion 12 at one side thereof which portion 12 encloses a suitable fly wheel (not shown) connected to suitably drive the rotatable portions of a comminution assembly 11. Housing 10 has a lower fabricated base portion 20 for supporting the comminution assembly 11, a material receiving hopper 22 and a motor 24 for selectively driving the fly wheel in a well known manner.

The comminution assembly 11 consists of a formed stationary bed member 16, carrying stationary bed knives 17, which is suitably rigidly secured with an upper section of the base 20 and a rotor member 18 carrying rotating knives 21. Rotor member 18 is rotatably driven by a central elongated shaft 19 which is supported for rotation by the bed member 16 in any suitable manner and is suitably rotatively driven by the fly wheel. For the purposes of this invention the comminution assembly 11 may be of any suitable configuration; however, the preferred form of the comminution assembly 11 is more particularly shown and described in U.S. Application Ser. No. 799,457, filed May 23, 1977, now abandoned, subsequently refiled as Ser. No. 936,366 filed 8-24-1978, which is assigned to the same assignee as is this invention and the disclosure thereof is incorporated herein for the purpose of the disclosure of this application.

A formed material feed hopper 26 is carried by the housing 10 upwardly adjacent the assembly 11 to receive the material to be fragmatized by the comminution assembly 11. For the purposes of this invention, the feed hopper 26 may be formed and supported by housing 10 in any suitable manner; however, the preferred structure and supporting arrangement for feed hopper 26 is more particularly shown and described as a sliding arrangement in my copending Application Ser. No. 854,129, filed Nov. 23, 1977, and assigned to the same assignee as this invention and the disclosure thereof is incorporated herein for the purpose of the disclosure of this invention.

As is known, the plastic material supplied to assembly 11 is fragmatized by the cooperable action of the bed and rotating knives 17 and 21, respectively, with the fragmatized particles passing through suitably sized openings in a sizing screen assembly 27 and thereafter such particles gravitationally fall into the material hopper 22. The plastic particles are conveyed from the hopper 22 by suitable conveying means; however, for the purposes of this invention, an elongated screw conveyor 28 is preferably utilized. Screw conveyor 28 is positioned adjacent the lower end of hopper 22 and extends along an axis parallel to and in the same vertical plane as the central rotation axis of shaft 19. The accumulated particles are conveyed by a continuous flight 29 of screw conveyor 28 and are discharged through an opening (not shown) adjacent an end portion of hopper 22. Screw conveyor 28 may be driven in any suitable manner; for example, conveyor 28 may be driven off of shaft 19 or, if preferred, may be driven directly from motor 24.

Figure 3:
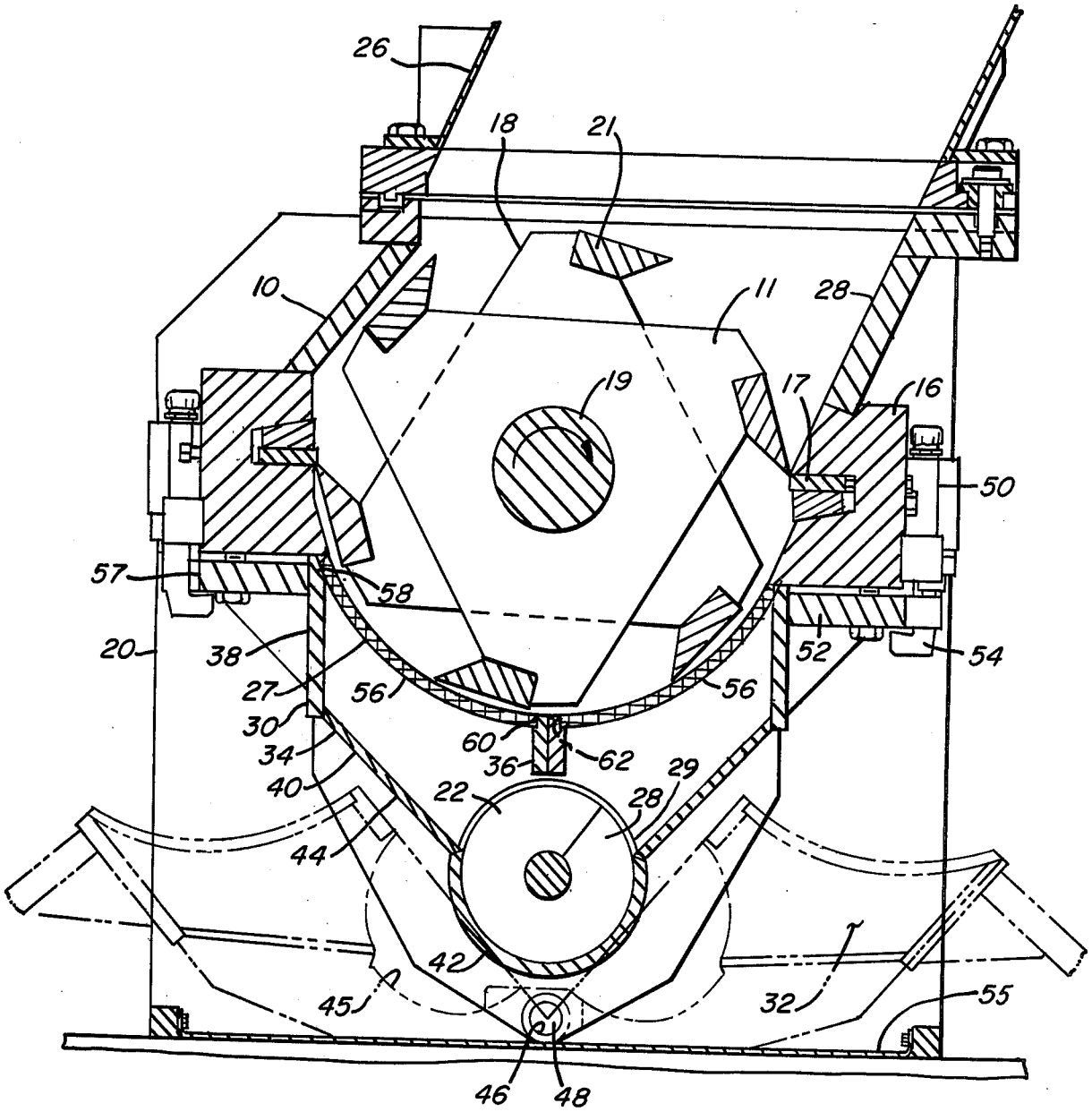
FIG. 3 is an enlarged cross-sectional view of a portion of a comminution device constructed in accordance with the principles of the present invention.

For purposes of description herein the ends and sides of hopper 22 shall refer, respectively, to the spaced ends thereof along the longitudinal rotation axis of screw conveyor 28 and the sides horizontally transverse thereof as viewed in FIG. 3.

Hopper 22 is of a generally downwardly inverted triangular shaped configuration in the closed position thereof and is formed from a pair of independent hopper half sections 30 which are selectively pivotal about a common axis to a closed position for receiving fragmatized particles therewithin and to an open position for readily gaining access to the interior of the hopper 22 and screen assembly 27. The pivot axis of hopper 22 is parallel to the rotation axis of shaft 19 and conveyor 28 and all three such axes are contained in a common vertical plane. This configuration provides for a low overall height of the comminution device of this invention. Such a low height results in a relatively low resultant overturning moment imparted by the impacting comminution assembly thus facilitating the base and base anchoring design as well as reducing clearance requirements.

Each hopper half section 30 comprises, with respect to the rotation axis of conveyor 28: longitudinally spaced end walls 32; an elongated side wall 34 having axial ends thereof secured to the adjacent end walls 32, respectively, at an upper end portion thereof; and an axially extending screen support member 36 having axial ends thereof secured to the adjacent end walls 32, respectively, at an upper inner end portion thereof. The side walls 34 include a vertically extending upper portion 38 and a lower sloped portion 40 which has an upper end thereof secured to portion 38 and extends inwardly and downwardly therefrom. A stationary upwardly open generally semicircular flight housing 42 is suitably carried by base portion 20 in a manner that the diametrically spaced ends thereof are respectively adjacent the inner lowermost ends of portions 40 when the hopper sections 30 are in the closed position. Each sloped portion 40 includes a downwardly extending gusset plate 44 depending therefrom with each gusset plate 44 having a bore 46 therethrough adjacent the lower innermost end thereof. In assembled position an elongated pivot pin 48, having the axial ends thereof suitably supported by base portion 20, extends through the aligned bores 46 in a direction parallel to the longitudinal axis of screw conveyor 28 and a location spaced downwardly from such axis and as closely adjacent the underside of housing 42 as is practical. The longitudinal axis of pivot pin 48 is contained in the same vertical plane as the rotation axis of the screw conveyor 28. Each wall 32 additionally includes an inwardly open generally semicircular opening 45 formed therein adjacent the inner side thereof. Opening 45 is struck from a radius generally equal to the outer radius of the flight housing 42 thereby providing an arrangement where openings 45 are closely received around housing 42 when the hopper half sections 30 are in the closed position.

With the configuration as described hereinabove, each hopper half section 30 is readily selectively pivotal about the pivot pin 46 to gain access to the interior of hopper 22 and screen assembly 27 when desired. FIG. 3 illustrates the hopper 22 in the closed position in solid lines and in the open position thereof in phantom. In the closed position, the lower ends of sloped portions 40 are adjacent the respective arcuate ends of the flight housing 42 to provide a relatively sealed hopper for the gravitational feed of fragmatized material therewithin. Furthermore, in the closed position of hopper 22, the screen support members 36 carried by each half section 30 are in abutting relationship with respect to each other to provide a continuous discharge screen assembly 27 across the entrance throat to the hopper 27. Suitable means, such as latching assemblies 50, are provided for the releasable retention of hopper half sections 30 in the closed positions thereof. A horizontally extending latching flange 52 extends outwardly from each vertical portion 38 adjacent the respective upper ends thereof. Latching assemblies 50 are suitably cooperable with flanges 52 for the selctive retention of half sections 30, for example; by providing latch members 54 which are selectively pivotal in an upper and lower position. In the upper position, the flanges 52 are released and hopper half sections 30 pivot outwardly and downwardly about pivot pin 48 until gusset plates 44 engage a horizontal extending stop plate 55 which is carried by base portion 20 below the hopper 22 (see FIGS. 2 and, in phantom, FIG. 3). In the lower position of latching members 54, a lower inwardly hooked end of each member 54 is received within a respective inwardly directed groove 57 in flanges 52 for the retention of half sections 30 in the closed positions thereof whereat the flanges 52 extend horizontally and are adjcent the lower surface of bed members 16.

Screen assembly 27 extends longitudinally between the end walls 32, has a generally arcuate shaped transverse configuration and consists of a pair of adjacently positioned screen portions 56. In the closed position of the discharge hopper 22, each screen portion 56 has the outer end thereof captively retained adjacent the respective upper end of vertical portion 38 of the respective side wall 34. This captive retention is provided by having an outwardly extending champher 58 in the upper end of portion 38 which is positioned such that the champher 58, in conjunction with the arcuate configuration of the adjacent screen portion 56 and the outer bias which is inherently imparted thereby, will provide a wedging effect to retain the outer end of the screen portion 56 adjacent the respective champher 58. Furthermore, when the discharge hopper 22 is in the closed position thereof the uppermost end of each screen portion 56 will additionally abut the lower innermost surface of bed member 16 thereby additionally captively retaining the upper end of screen portions 56 in the operational position thereof such as illustrated in FIG. 3. The inner end of each screen portion 56 is seated on an outwardly facing seat 60 which is formed within the upper end portion of each screen support member 36. Any suitable means may be provided for releasably retaining the seating arrangement of screen portions 56 on seats 60 and, as shown, one such arrangement includes a plurality of transversely extending countersunk screws 62 extending between the support 36 and the respective screen portions 56.

With such an arrangement as described hereinabove, the discharge screen assembly 27 is provided with a three-point support across the arcuate length thereof (i.e. end supports at each champher 58 and midpoint support at screen support members 36), thereby reducing the maximum moment across the assembly 27 in comparison with the two point support discharge screen utilized heretofore. Furthermore, inasmuch as each screen portion 56 is, with respect to the pivot axis thereof, captively supported adjacent the outer end and releasably retained adjacent the inner end, the screen portions 56 are easily removed by unscrewing the countersunk screws 62 as screws 62 are readily accessible when the hopper half sections 30 are pivoted to the open positions thereof. After screws 62 are removed, screen portions 62 are simply picked up for the removal thereof inasmuch as they are free of the hopper sections 30 and access thereto is readily available since the sections 30 have been pivoted to the open position. Still further, when the hopper half sections 30 are opened, relatively free access to the screw conveyor 28 is achieved for purposes of cleaning, dejamming, and the like.

The embodiment described herein is the presently preferred embodiment of a comminution device constructed in accordance with the principles of the present invention; however, it is understood that various modificartions may be made to the embodiment described herein by those knowledgable in the art without departing from the scope of the invention as defined by the claims setforth hereinafter. For example: the invention herein is equally applicable to comminution devices other than the application to a plastics granulator as is described herein; rather than utilizing a stationary flight housing 42, the housing 42 may be split and rendered pivotable with each half section 30; the structural configuration of hopper 22 may be varied; a low height orbit conveyor may be substituted for the screw conveyor 28; and the like.

What is claimed is:

1. A comminution device comprising: a housing member; comminution means supported by said housing member and operable to effect size reduction of material supplied thereto to provide particles of such material; hopper means supported by said housing member downwardly adjacent said comminution means to receive said particles of such material from said comminution means subsequent to such size reduction; and said hopper means including at least a pair of hopper portions which are selectively pivotable into a closed position for receiving said particles therein and into an open position for providing access to the interior of said housing member.

2. A comminution device as specified in claim 1 additionally including mechanical conveying means disposed within a lowermost portion of said hopper means and operable to convey said particles from said hopper means.

3. A comminution device as specified in claim 2 wherein said conveying means is supported by said housing member.

4. A comminution device as specified in claim 2 wherein said comminution means includes a rotatable cutter portion; said hopper portions being pivotable about a common pivot axis; said conveying means being rotatable about an elongated axis; and the rotation axis of said cutter portion, said elongated axis and said common pivot axis being located in a common vertically extending plane.

5. A comminution device as specified in claim 1 wherein said comminution means includes a rotatable cutter portion, elongated screen means of a generally arcuate transverse cross section which when said hopper portions are closed is disposed intermediate the flow path of said particles from said cutter portion to said hopper means to limit the maximum size of said particles received within said hopper means, and said hopper portions having elongated first support portions supportively engageable with outer longitudinally extending edges of said screen means, respectively.

6. A comminution device as specified in claim 5 wherein said first support portions are laterally spaced in opposite directions from the rotation axis of said cutter portion, respectively.

7. A comminution device as specified in claim 6 wherein said hopper means includes an elongated second support portion intermediate said first support portions which supports said screen means at a location substantially equidistant from each of said longitudinally extending edges.

8. A comminution device as specified in claim 9 wherein said second support portion includes a pair of elongated members having the axial ends thereof supported by said hopper portions respectively.

9. A comminution device as specified in claim 8 wherein when said hopper portions are in the closed positions adjacent portions of said elongated members are in abutting relationship and when said hopper portions are in the open positions said adjacent portions are spaced from each other.

10. A comminution device as specified in claim 8 wherein said screen means includes a pair of screen portions with each of said screen portions being releasably secured to a respective one of said elongated members by removable fastening means.

11. A comminution device as specified in claim 10 wherein said elongated members are located to prevent access to said fastening means when said hopper portions are closed.

12. A comminution device as specified in claim 5 wherein said screen means includes a pair of screen portions supported by said hopper portions respectively.

13. A comminution device as specified in claim 5 wherein the edges of said screen means are supported by said first support portions by captive engagement with said housing member.

14. A comminution device as specified in claim 1 wherein said comminution means includes an elongated rotatable cutter portion rotatable about a central axis, and said hopper portions being pivotable about a common pivot axis parallel to said central axis and spaced downwardly from said central axis.

15. A comminution device as specified in claim 1 wherein said comminution means includes an elongated cutter portion rotatable about a central axis thereof, said hopper portions being pivotable about a common pivot axis spaced laterally and downwardly from said central axis, sizing screen means having elongated transversely contiguous and coextensive screen portions carried by said hopper portions respectively, said screen portions being located in the flow path of said particles from said cutter portion to said hopper means when said hopper portions are in the closed position, and said screen portions being spaced laterally and downwardly from said central axis.

16. A comminution device as specified in claim 15 wherein said pivot aixs is parallel to said central axis.

17. A comminution device as specified in claim 16 wherein said screen portions have adjacent longitudinally extending edges releasably secured to said hopper portions respectively.

18. A comminution device as specified in claim 17 wherein said releasable securing is by fastening means which are inaccessible when said hopper portions are in the closed position.

19. A comminution device as specified in claim 15 wherein each of said screen portions have a generally arcuate transverse cross section including uppermost transversely spaced outer longitudinally extending edges which edges are captively supported with respect to said hopper means and said housing member when said hopper portions are in the closed position.

20. A comminution device as specified in claim 15 wherein said screen portions are freely supported by said hopper portions in the open position.

* * * * *